United States Patent [19]

Dexter

[11] 4,249,037

[45] Feb. 3, 1981

[54] PYRAMID LOUDSPEAKERS WITH TWIN CROSS-PHASED MID-RANGE SPEAKERS

[76] Inventor: John L. Dexter, 791 Cascade Dr., Sunnyvale, Calif. 94086

[21] Appl. No.: 958,732

[22] Filed: Nov. 8, 1978

[51] Int. Cl.[3] ..... H04R 1/02

[52] U.S. Cl. ..... 179/1 GA; 181/144; 179/1 E

[58] Field of Search ..... 179/1 GA, 1 E; 181/144, 181/147, 154, 156, 151

[56] References Cited

U.S. PATENT DOCUMENTS

| | | | |
|---|---|---|---|
| 3,136,383 | 6/1964 | Hopkins | 181/145 |
| 3,164,676 | 1/1965 | Brunner | 179/1 G |
| 3,326,321 | 6/1967 | Valuch | 181/156 |
| 3,637,938 | 1/1972 | Kuhlow | 181/147 |
| 4,006,308 | 2/1977 | Pönsgen | 181/147 |
| 4,031,318 | 6/1977 | Pitre | 179/1 E |
| 4,051,919 | 10/1977 | Buettner | 181/144 |

FOREIGN PATENT DOCUMENTS

| | | | |
|---|---|---|---|
| 2709952 | 9/1978 | Fed. Rep. of Germany | 179/1 GA |

*Primary Examiner*—Douglas W. Olms
*Attorney, Agent, or Firm*—Paul Hentzel

[57] ABSTRACT

A truncated, open top, pyramid housing is provided containing a downwardly propagating woofer mounted near the base of the pyramid; a forwardly and slightly upwardly propagating tweeter mounted on the front side of the pyramid; and a pair of rearwardly propagating, crossed polarity, mid-range speakers mounted on opposed sides of the pyramid housing. The push-pull propagation between the opposed mid-range speakers, within a single housing, and similar cooperation between stereo loudspeaker pairs, provides a generally phase distortion free, wide dispersion sound circulation. A polarity switch is provided for establishing the desired cross-phase relationship. The nonparallel side configuration of the housing reduces internal resonance by preventing standing wave formation. The open top functions as an unidirectional port which also reduces internal resonance. The upward portion of each sound cycle is guided out of the speaker housing towards the ceiling by the funneling action of the slanted, tapered sides. The return wave, however, is not guided back into the port, thus reducing the feedback energy required to support internal resonance. The housing may be packed with acoustical material to increase its effective acoustical volume.

27 Claims, 8 Drawing Figures

PYRAMID LOUDSPEAKERS WITH TWIN CROSS-PHASED MID-RANGE SPEAKERS

BACKGROUND OF THE INVENTION

This invention relates to the design of speaker systems and more particularly, to such speakers operated in cross-phase.

Heretofore, twin speakers within the same housing have had a common polarity and direction to avoid cancellation losses. Stereo loudspeaker pairs were likewise connected in matched polarity. The resulting sound within the listening zone formed a pattern of impinging compression waves. A point sound source recorded in stereo and played back through conventional matched loudspeakers, has a double impression when perceived in binaural hearing. The double impression reduces the clarity of the sound. The impression from the left speaker registers first on the left ear and then on the right ear. The impression from the right speaker registers first on the right ear and then on the left ear. The result is four discrete registrations of the point source instead of the two originally recorded. The delay between corresponding registrations is caused by the ear spacing. Cross-phasing the stereo speakers places one set of impressions into the rarification portion of the sound cycle during the same period in which the other set of impressions is in the compression portion of the cycle. The cross-phasing reduces the apparent impact on the ear of the presence of the two sets of impressions, resulting in improved transient clarity.

SUMMARY OF THE INVENTION

It is therefore an object of this invention to provide a loudspeaker with less internal resonance.

It is another object of this invention to provide a loudspeaker with an improved sound propagation.

It is a further object of this invention to provide a loudspeaker system with a more uniform sound circulation.

It is yet another object of this invention to provide a loudspeaker with reduced external resonance and wall loading.

It is yet a further object of this invention to provide a loudspeaker with a highly stable dimension-weight configuration.

It is still another object of this invention to provide a loudspeaker having an attractive housing requiring a minimum number of surfaces.

It is still a further object of this invention to provide a loudspeaker which provides an impression of truer fidelity and higher clarity.

BRIEF DESCRIPTION OF THE DRAWINGS

These and other objects and advantages of the present invention will become apparent to those skilled in the art from the following detailed description and accompanying drawings, in which:

FIG. 1 shows triangular pyramid embodiment 100 of the loudspeaker invention formed by enclosure housing 110 containing downward directed woofer 114 mounted on base 118, frontwards directed tweeter 120 mounted on front face 130F and twin rearward directed midrange speakers 128L and 128R mounted on rear faces 130L and 130R respectively. Dispersion cone 132 is formed in the center region of base 118 for establishing an omnidirectional base from woofer 114. The pyramid configuration of enclosure 110 establishes an incline or pitch for each face thereof. The pitch of front face 130F directs tweeter 120 slightly upwards toward the listening zone. The pitch of rear face 130L and 130R direct midrange speakers 128L and 128R upwards in a similar manner. Housing 110 is truncated at the apex to provide top port 148. A support foot 152 is provided at each corner of base 118. Bottom port 156 is provided between support feet 152.

FIG. 2 is a schematic of the wiring within enclosure 110 showing three parallel branches—tweeter branch 210T, woofer branch 210W, and midrange branch 210MR. Capacitor 214 in tweeter branch 210T forms a high pass filter to tweeter 120. Potentiometer 218 permits volume adjustment of tweeter 120 independently of woofer 114 and midrange speaker 128L and 128R. Inductor 222 in woofer branch 210W forms a low pass filter to woofer 114. Capacitor-inductor network 228 forms a band pass filter to midrange speakers 128L and 128R.

Midrange speakers 128 are wired in cross-polarity relationship to provide cross phased sound sources having a left and a right azmith respectively. The outward or positive cycle of right midrange speaker 128R causes a soundwave to be pushed toward the right. Simultaneously, the inward or negative cycle of left midrange speaker 128L supplements this right push by causing a corresponding soundwave to be pulled from the left. This "push-pull" cooperation promotes transmission of the midrange frequencies. Local cancellation is minimized by spacing the speakers by more than one wave path length of the lowest operating frequency.

Figure 2:
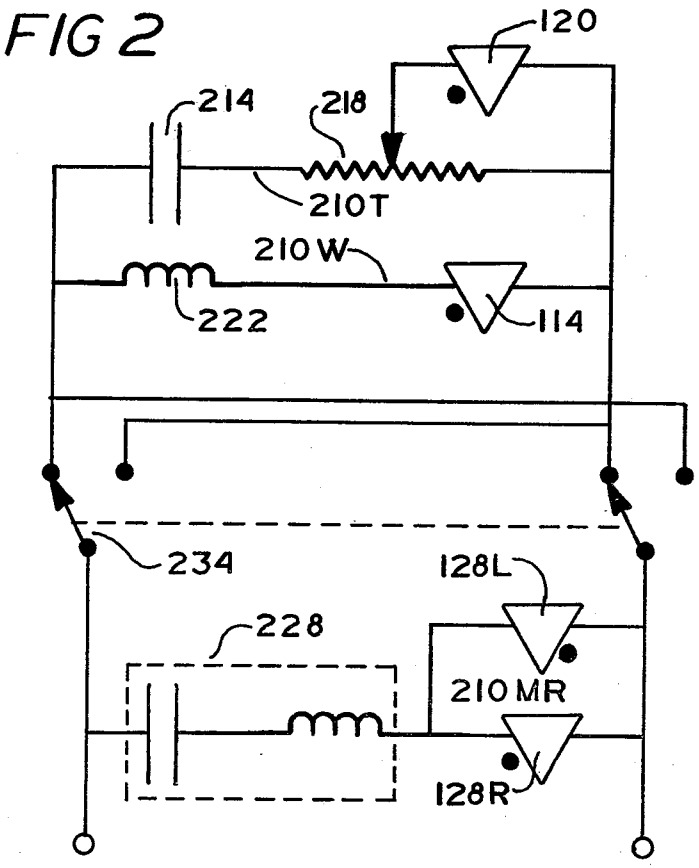
FIG. 2 is a schematic diagram of the woofer, tweeter, and midrange branches of the loudspeaker of FIG. 1.
Figure 1:
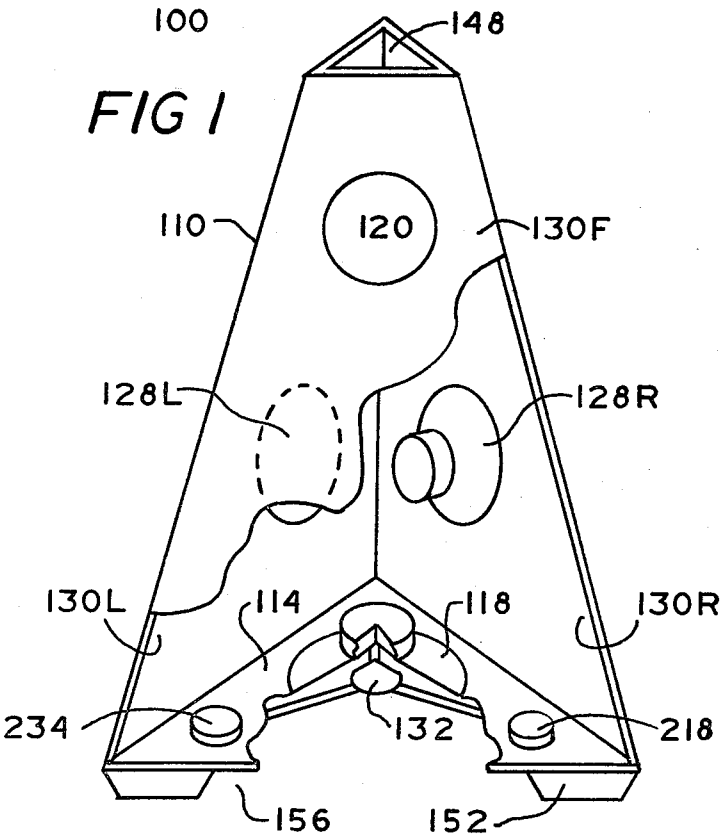
FIG. 1 is a front view of a pyramid loudspeaker partially broken away, showing the individual speakers.

Tweeter 120 and woofer 114 are wired in phase and may be placed in phase with either midrange speaker 128L or 128R by enclosure phase switch 234. The single pole double throw action of phase switch 234 reverses the connection between the midrange branch and the combined woofer-tweeter branches. When two pyramid loudspeakers are employed in the conventional stereo relationship, it is preferred that the woofer and tweeter in the left-hand loudspeaker be in phase with the right midrange speaker in the same loudspeaker (as shown in FIG. 2), and that the woofer and tweeter in the right-hand loudspeaker be in phase with the left midrange speaker in the right-hand loudspeaker. The woofer and tweeter within one loudspeaker are in phase with each other, but out of phase with the woofer and tweeter in the other loudspeaker.

Figure 3B:
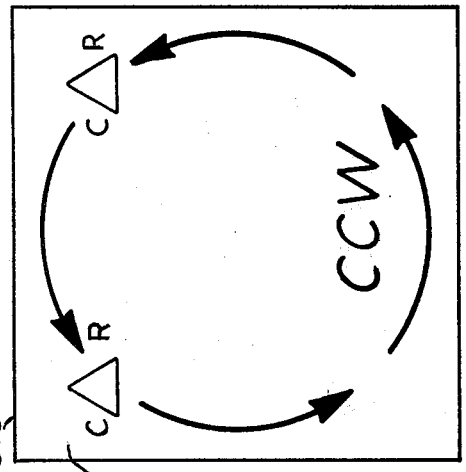
FIGS. 3A and B show the circulation sound propagation mode established by the cross-phased midrange speakers.
Figure 3A:
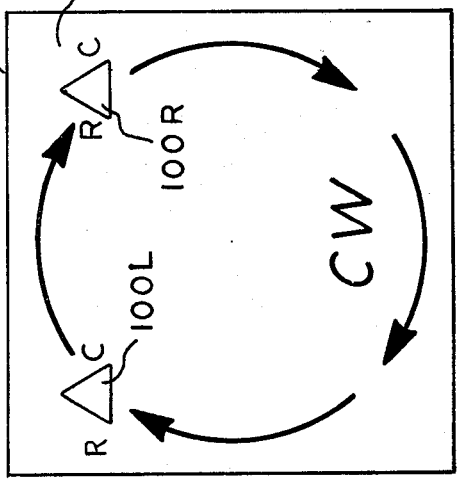

FIGS. 3A and 3B show one arrangement of a pair of loudspeakers, 100R and 100L, positioned in the corner adjacent wall 310 within listening room 316. Midrange speakers 128R, within each loudspeaker 100L and 100R, are connected in the same polarity and are shown in FIG. 3A during the compresion (c) cycle and in FIG. 3B during the rarification (r) cycle. The other midrange speaker 128L within each loudspeaker 100R and L100 are connected in the opposite polarity as midrange speakers 128R. The push-pull cooperation between both midrange speakers 128 within loudspeaker 100R is supplemented by the push-pull cooperation within loudspeaker 100L, causing a circulation of midrange soundwaves back and forth along wall 310 and CW and CWW around room 316, as shown in FIGS. 3A and 3B respectively.

The circulation mode shown in FIGS. 3A and B is in contrast to the traditional matched polarity mode where a pair of speakers are aimed toward the center of the listening area and energized in phase. The interfacing of in phase, opposed, sound waves produce a reinforcement interference pattern which introduces harmonic distortion. The cross-phased sound waves of FIGS. 3A and B are a constant 180 degrees out of phase at any listening position throughout room 316. In the matched phase opposed sound source configuration, the phase relationship of the two sound waves varies across the listening zone in front of the speakers. In addition, the compression-to-rarification ratio generated during reinforcement by the traditional in phase mode is twice as high as the cross-phase circulation mode for the same acoustical output. This higher peak to peak air pressure introduces twice the wall loading and sound transmission into adjacent rooms than the cross-phased circulation mode of FIG. 3.

The pyramid shape of loudspeaker 100 prevents the build up of internal resonance or standing waves for reducing "booming" and "hang-over" effects. The non-parallel relationship of faces 130F, 130L and 130R forces each internally reflected sound wave to propagate in a direction different from the initial indicent sound wave; and prevents previous cycles of sound from assisting subsequent cycles of sound in a resonant buildup. The non-parallel enclosure surfaces cannot support standing waves and act in a "damping" capacity. In addition, the reflected waves within housing rapidly lose phase relationship due to the divergent path lengths. Inclined sides 130 of housing 110 create a funnel effect which collects the back compression waves from woofer 114 and guides them out top port 148 upwards towards the ceiling. The reflected downward waves are dispersed outwardly by inclined sides 130. The reflected wave does not re-enter housing 110 through top port 148 as readily as the initial wave exited. As a result, less return energy is available positive feedback to support resonance. Pyramid enclosure 110 can be viewed as a passive device having a very low and very broad "Q" with negligible resonant capability.

Figure 4:
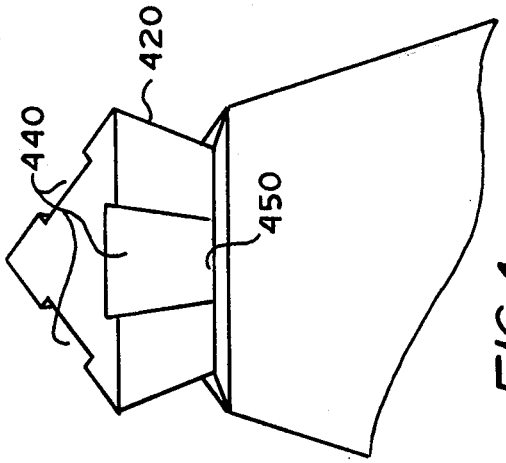
FIG. 4 is a fragmentary perspective view of a sound diffuser mounted the loudspeaker top port.

FIG. 4 shows an inverted pyramid port diffuser 420 positioned in top port 148. The three sides of diffuser 420 have large flutes 440 formed therein which function as smaller top ports 450. The outward slope of the flutes diffuses the upward compression wave laterally as the low frequency sound passes out ports 450. Other baffling techniques may be employed such as the use of baffle 506 shown in FIG. 5.

The low center of gravity and wide base of the pyramid loudspeaker create a highly stable unit, unlikely to be accidently toppled and damaged. Heavy bottom mounted woofer 114 and base member 118 contribute towards the low center of gravity, along with progressively diminishing mass of the enclosure material in the upper region of enclosure 110. Further, enclosure 110 may be fabricated from a minimum of siding material, as is evident from the following considerations: the triangle shape of sides 130 have a smaller area than the sides of the traditional rectangular housing, only three sides are required due to the three side configuration of base 118, and no top member is required. The lower actual volume of housing 110 may be offset by filling the housing with an acoustical absorbent material, such as fiberglass, which increases the housing effective volume by a factor of 1.4. Preferably, sides 130 are made of a dense, low resiliance material such as particle board or plywood with an inner lining of a damping material such as an asphalt coating or sheeting.

Figure 6:
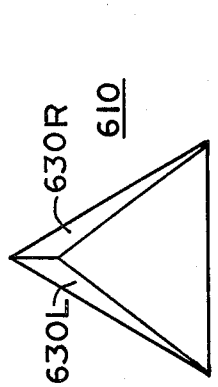
FIG. 6 is a top view of a pyramid speaker having an unsymmetrical housing.
Figure 5:
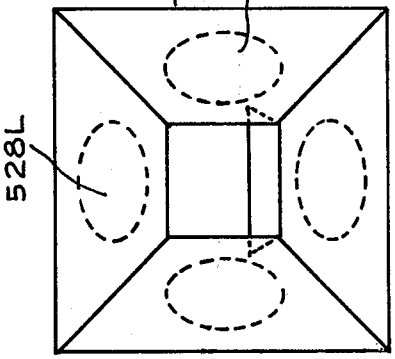
FIG. 5 is a top view of a pyramid speaker having a square base.

The housing may have more than three sides. FIG. 5 shows a top view housing 510 with a square base and midrange speakers 528L and 528R, mounted on adjacent sides thereof. The number of sides employed may vary with the desired acoustical and asthetic effects. Further, the housing need not be formed of identical isosceles triangles with identical truncations. FIG. 6 shows housing 610, having irregular rear faces 630L and 630R at an almost vertical pitch.

The outside dimensions of a panel suitable for a pyramid loudspeaker formed by three identical panels housing a six inch woofer (600 cubic inches) and having a woofer-midrange crossover of 800 cps and a midrange-tweeter crossover of 5000 cps, are: height 20", base width 16" and top width 4". The outside dimensions of a panel suitable for housing an eight inch woofer (1200 cubic inches) are: height 27", base width 20", and top width 5".

Figure 7:
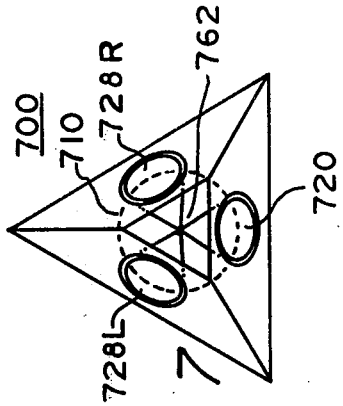
FIG. 7 is a top view of a phase alined loudspeaker showing the "throat" of each speaker thereof coaxially positioned.

FIG. 7 shows a phase alined loudspeaker 700 which provides a higher fidelity impression. The apex or throat of tweeter 720 and midrange speakers 728L and 728R are mounted proximate the vertical axis 762 of woofer 714 for establishing the phase alinement. Tweeter 720 and midrange speakers 728 may be mounted near the top of housing 710 in order to facilitate positioning the throats of these speakers near vertical axis 762. Alternatively, a deeper speaker such as a horn type speaker may be employed.

It will be apparent to those skilled in the art, that the objects of this invention have been accomplished by providing cross-phased twin speakers in a pyramid housing. The pyramid housing reduces internal resonance and establishes an upward pitch to the propagation of the tweeter speaker and midrange speakers. The opposed orientation of the twin speakers supports improved sound circulation, while the cross-phase relationship improves the directionality and central image of the sound pattern.

Changes and modifications may be made in the embodiments shown without departing from the scope of the invention. For example, the speaker housing may have any number of sides or even be cone shaped. The cross-phase sound may be provided by a single midrange speaker transversely mounted within a duct which opens onto opposed sides of the housing. One end of the duct provides the front wave of the midrange sound and the other end of the duct provides the back wave which is 180° out of phase with the front wave. Accordingly, the scope of the invention should be determined only by the wording of the following claims and their legal equivalents.

I claim as my invention:

1. A loudspeaker unit responsive to a single input signal for providing lower frequency sound and at least two cross-phased higher frequency sound fronts angularly displaced with respect to one another forming an unsymmetrical sound propagation field, comprising:

a housing having at least a first side and a second side angularly displaced with respect to one another, each side having an opening means for directing at least a first sound front and a second sound front in angularly displaced directions forming an unsymmetrical sound propagation field, a lower frequency speaker means mounted within the housing and responsive to the single input signal for providing sound at frequencies primarily below a predetermined frequency; and at least a first and a second higher frequency speaker means mounted on the first and second angularly displaced sides, and responsive to the single input signal for generating the first and second sound fronts at frequencies above a predetermined frequency in angularly displaced directions and in cross-phased relationship in which as the first sound front is generated in compression the second sound front is generated in rarification and as the first sound front is generated in rarification the second sound front is generated in compression.

2. The loudspeaker unit of claim 1, wherein the housing comprises a plurality of side members.

3. The loudspeaker unit of claim 1, wherein the lower frequency speaker means is a woofer speaker means, and the higher frequency speaker means comprises:

a tweeter speaker means; and at least a first and a second midrange speaker mounted on the first and second sides of the housing for generating the first and second sound fronts, the first and second midrange speakers connected in cross polarity relationship with respect to one another for causing the cross phase relationship between the first and the second sound fronts.

4. The loudspeaker unit of claim 3, wherein at least one of the side members is inclined.

5. The loudspeaker unit of claim 4, wherein the woofer speaker is mounted within the lower portion of the housing and directed downwardly.

6. The loudspeaker unit of claim 5, wherein the housing further includes a base member for supporting the woofer speaker means.

7. The loudspeaker unit of claim 6, wherein the base member includes a cone means for directing the low frequency sound from the woofer speaker means.

8. The loudspeaker unit of claim 5 wherein the housing is a regular pyramid formed by four identical sides and a square base.

9. The loudspeaker unit of claim 5, wherein the housing is a three sided pyramid having a triangle base.

10. The loudspeaker unit of claim 9, wherein the housing is a regular pyramid formed by three identical sides and the base is an equilateral triangle.

11. The loudspeaker unit of claim 9, wherein the three sides are truncated at the top for providing a top base port.

12. The loudspeaker unit of claim 11, further comprising an inverted pyramid sound diffuser mounted in the top port.

13. The loudspeaker unit of claim 9, wherein the housing has three foot supports, one at each corner thereof, for supporting the housing and for providing a woofer port along the lower portion of each side between the foot supports.

14. The loudspeaker unit of claim 3, wherein the at least two midrange speakers are at least one left speaker, and at least one right speaker connected in cross-phase with the at least one left midrange speaker.

15. The loudspeaker unit of claim 14, wherein the tweeter speaker means is connected in phase with the woofer speaker means.

16. The loudspeaker unit of claim 15, wherein the tweeter speaker means and the woofer speaker means are connected in phase with right midrange speaker.

17. The loudspeaker unit of claim 15, wherein the tweeter speaker means and the woofer speaker means are connected in phase with the left midrange.

18. The loudspeaker unit of claim 15, further comprising an electric switch means for switching the tweeter speaker means and the woofer speaker means in phase with either the left or the right midrange speaker as desired.

19. The loudspeaker unit of claim 18, wherein the electric switch means is a single pole-double throw switch for changing the phase relationship of the tweeter speaker means and the woofer speaker means as a unit with respect to the midrange speakers.

20. The loudspeaker unit of claim 15, wherein each side of the plurality of sides is inclined, and the throats of the tweeter speaker and the midrange speakers are positioned proximate a vertical axis passing through the throat of the woofer speaker, whereby the phase alinement of the sound from the loudspeaker unit is enhanced.

21. The loudspeaker unit of claim 20, wherein the plurality of sides have identical dimensions.

22. The loudspeaker unit of claim 15, wherein a top port is provided through the housing.

23. The loudspeaker unit of claim 5, wherein the tweeter speaker means is mounted on the front side of the housing.

24. The loudspeaker unit of claim 23, wherein the front side is inclined causing the tweeter speaker means to propagate at an upward pitch.

25. The loudspeaker unit of claim 24, wherein the tweeter speaker means is mounted near the top of the front side.

26. The loudspeaker unit of claim 5, further comprises an asphalt damping material on the inside surfaces of the faces.

27. A stereo loudspeaker system comprising:

a left loudspeaker unit and a right loudspeaker unit each having a housing;

each loudspeaker unit having tweeter speaker and a woofer speaker and left directed midrange speaker and a right directed midrange speaker;

in the left loudspeaker unit the tweeter speaker and the woofer speaker and the right directed midrange speaker are connected in the same polarity, and the left directed midrange speaker is connected in the other polarity; and in the right hand loudspeaker unit the tweeter speaker and the woofer speaker and the left directed midrange speaker are connected in other polarity, and the right directed midrange speaker is connected in the same polarity.

* * * * *